US009371122B2

(12) United States Patent
Nakamura

(10) Patent No.: US 9,371,122 B2
(45) Date of Patent: Jun. 21, 2016

(54) VESSEL PROPULSION APPARATUS

(71) Applicant: YAMAHA HATSUDOKI KABUSHIKI KAISHA, Iwata-shi, Shizuoka (JP)

(72) Inventor: Ryou Nakamura, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 19 days.

(21) Appl. No.: 14/277,841

(22) Filed: May 15, 2014

(65) Prior Publication Data

US 2015/0050848 A1 Feb. 19, 2015

(30) Foreign Application Priority Data

Aug. 19, 2013 (JP) ..... 2013-169812

(51) Int. Cl.

| | |
|---|---|
| ***B63H 20/20*** | (2006.01) |
| ***B63H 20/32*** | (2006.01) |
| ***B63H 20/00*** | (2006.01) |
| ***B63H 20/24*** | (2006.01) |
| ***F02M 35/16*** | (2006.01) |

(52) U.S. Cl.

CPC ..... *B63H 20/32* (2013.01); *B63H 20/20* (2013.01); *B63H 20/24* (2013.01); *B63H 20/245* (2013.01); *B63H 21/265* (2013.01); *F02M 35/167* (2013.01)

(58) Field of Classification Search

CPC ..... B63H 20/20; B63H 20/32

USPC ..... 440/77

See application file for complete search history.

(56) References Cited

U.S. PATENT DOCUMENTS

| | | | | | |
|---|---|---|---|---|---|
| 5,797,776 | A * | 8/1998 | Kusche | B63H 20/00 | 440/52 |
| 6,478,642 | B1 * | 11/2002 | Kolb | B63H 20/002 | 123/196 A |
| 7,156,709 | B1 * | 1/2007 | Staerzl | B63H 20/10 | 440/61 G |
| 7,217,166 | B2 * | 5/2007 | Fukuoka | F02B 61/045 | 440/77 |
| 7,249,985 | B2 * | 7/2007 | Fukuoka | F16J 15/062 | 277/641 |
| 7,524,223 | B2 * | 4/2009 | Ochiai | B63H 20/32 | 440/88 A |
| 2003/0232548 | A1 * | 12/2003 | Alby | F02B 61/045 | 440/77 |
| 2007/0243776 | A1 * | 10/2007 | Hasegawa | B63H 20/32 | 440/77 |
| 2008/0003896 | A1 * | 1/2008 | Takashi | F02M 35/09 | 440/77 |
| 2015/0050848 | A1 * | 2/2015 | Nakamura | B63H 20/32 | 440/77 |

FOREIGN PATENT DOCUMENTS

| | | | |
|---|---|---|---|
| JP | 2010-025004 A | | 2/2010 |
| JP | 2010025004 A | * | 2/2010 |

* cited by examiner

*Primary Examiner* — Lars A Olson
*Assistant Examiner* — Jovon Hayes
(74) *Attorney, Agent, or Firm* — Keating and Bennett, LLP

(57) ABSTRACT

A vessel propulsion apparatus includes an engine main body including a crankshaft that is rotatable about a rotation axis extending in the up-down direction, auxiliary machinery mounted on the engine main body, a bracket that couples the auxiliary machinery to the engine main body, and an engine cowling that houses the engine main body, the auxiliary machinery, and the bracket. The bracket includes a first mounting portion mounted on the engine main body, a second mounting portion mounted on the auxiliary machinery, a coupling portion coupling the first mounting portion and the second mounting portion, and a holding portion provided in the coupling portion. The holding portion of the bracket holds piping.

10 Claims, 9 Drawing Sheets

PRIOR ART

VESSEL PROPULSION APPARATUS

BACKGROUND OF THE INVENTION

1. Field of the Invention

The present invention relates to a vessel propulsion apparatus.

2. Description of the Related Art

Outboard motors include engines that generate power and engine cowlings that house the engines. Wiring and piping are disposed in the interior of the engine cowlings. For example, Japanese Patent Application Publication No. 2010-25004 discloses piping 100 that is disposed in a cowling. As shown in FIG. 12, the piping 100 extends from a silencer case 131 of an intake system 130 to the vicinity of a pulley 123 passing by the left side of a flywheel 125.

In the outboard motor, downsizing of the engine cowling that houses the engine is demanded in some cases. In some other cases, it is demanded to increase the power of the outboard motor that will lead to an increase in the size of the engine. Thus, conflicting demands of an increase in the size of the engine and downsizing of the engine cowling are sometimes made.

In Japanese Patent Application Publication No. 2010-25004, the piping 100 extends in the front-rear direction on the left side of the engine main body. In this configuration, when the cowling is downsized, the piping may wear or be damaged due to sliding of the cowling and piping, because the inner surface of the cowling approaches the piping. Therefore, it is difficult to downsize the cowling. In particular, when the engine main body is increased in size, the piping approaches the inner surface of the cowling, so that it is more difficult to downsize the cowling. In some situations, an increase in the size of the engine cowling is thus required.

SUMMARY OF THE INVENTION

In order to overcome the previously unrecognized and unsolved challenges described above, a preferred embodiment of the present invention provides a vessel propulsion apparatus including an engine main body including a crankshaft that is rotatable about a rotation axis extending in an up-down direction; auxiliary machinery mounted on the engine main body; a bracket that couples the auxiliary machinery to the engine main body, the bracket including a first mounting portion mounted on the engine main body, a second mounting portion mounted on the auxiliary machinery, a coupling portion coupling the first mounting portion and the second mounting portion, and a holding portion provided in the coupling portion and configured to hold wiring or piping; and an engine cowling that houses the engine main body, the auxiliary machinery, and the bracket. The wiring may be a signal line to transmit an electrical signal, or may be a power line to supply the electric power of a power supply to electrical equipment. The piping may be piping to guide gas or liquid, or may be piping to guide both of gas and liquid.

According to this arrangement of a preferred embodiment of the present invention, the crankshaft that is rotatable about the rotation axis extending in the up-down direction is provided in the engine main body. The engine main body is disposed inside the engine cowling. Similarly, the auxiliary machinery to assist the engine main body and the bracket to mount the auxiliary machinery on the engine main body are disposed inside the engine cowling. The first mounting portion of the bracket is mounted on the engine main body, and the second mounting portion of the bracket is mounted on the auxiliary machinery. The auxiliary machinery is thus coupled to the engine main body.

The bracket holds wiring or piping (hereinafter, referred to as "wiring or the like") by the holding portion provided in the coupling portion that couples the first mounting portion and the second mounting portion each other. That is, the bracket not only mounts the auxiliary machinery on the engine main body, but also holds the wiring or the like. Thus, as compared with a case of providing a bracket for the wiring or the like in addition to a bracket for the auxiliary machinery, the number and size of the structural elements that are housed inside the engine cowling are reduced. The engine cowling is thus downsized. Further, even if the engine main body is increased in size, an increase in the size and number of structural elements included in the engine cowling is minimized or prevented, so that an increase in the size of the engine cowling is minimized or prevented.

In a preferred embodiment of the present invention, the holding portion is preferably disposed farther inward than the auxiliary machinery with respect to an inner surface of the engine cowling.

According to this arrangement of a preferred embodiment of the present invention, the distance from the inner surface of the engine cowling to the holding portion of the bracket preferably is longer than the distance from the inner surface of the engine cowling to the auxiliary machinery. The holding portion of the bracket is thus disposed farther inward than the auxiliary machinery with respect to the inner surface of the engine cowling. Therefore, the wiring or the like does not easily contact the engine cowling. Further, even when the wiring or the like is disposed outward as a result of an increase in the size of the engine main body, the wiring or the like does not easily contact the engine cowling. As a result, wearing of or damage to the wiring or the like due to sliding of the wiring or the like and the engine cowling is significantly reduced or prevented.

In a preferred embodiment of the present invention, the holding portion preferably includes a first piping mounting portion in which first piping is mounted and a second piping mounting portion in which second piping is mounted. The bracket may further include a cylindrical inner peripheral surface that defines a penetration hole as a relay passage extending from the interior of the first piping to the interior of the second piping.

According to this arrangement of a preferred embodiment of the present invention, the first piping and the second piping that define a common passage are mounted in the first piping mounting portion and the second piping mounting portion of the bracket, respectively, and the inner peripheral surface of the bracket defines a penetration hole as a relay passage extending from the interior of the first piping to the interior of the second piping. That is, the bracket not only holds the first piping and the second piping, but also defines a common passage with the first piping and the second piping.

In this manner, the bracket itself defines a passage, and therefore, the length of the piping is reduced. The structural elements provided in the cowling are thus reduced in size and number. Further, because the length of the piping is reduced, displacement of the piping by vibration is significantly reduced or prevented. A positional change of the piping is thus prevented. Moreover, because the first piping and the second piping are mounted on the bracket that is higher in rigidity than the first piping and the second piping and the bracket is mounted on the engine main body, displacement of the first piping and the second piping is further reduced or prevented. Wearing of or damage to the piping due to sliding of the piping and another member is thus further reduced or prevented.

In a preferred embodiment of the present invention, at least a portion of the holding portion preferably surrounds the periphery of the wiring or piping.

According to this arrangement of a preferred embodiment of the present invention, the wiring or the like is disposed in a portion in the interior of the bracket, and the periphery of the wiring or the like is surrounded by the holding portion of the bracket. Movement of the wiring or the like is thus prevented by the bracket. The wiring or the like is thus increased in stability. Therefore, wearing of and damage to the wiring or the like due to sliding of the wiring or the like and another member is further reduced or prevented.

In a preferred embodiment of the present invention, at least a portion of the holding portion preferably has a C-shaped cross-section disposed on the periphery of the wiring or piping.

According to this arrangement of a preferred embodiment of the present invention, the holding portion of the bracket includes a C-shaped portion that has a C-shaped cross-section, and the wiring or the like penetrates the C-shaped portion. The periphery of the wiring or the like is surrounded by the C-shaped portion. The force that restrains the wiring or the like by the bracket is thus increased, and movement of the wiring or the like is reliably prevented. Wearing of or damage to the wiring or the like due to sliding of the wiring or the like and another member is thus further reduced or prevented.

In a preferred embodiment of the present invention, at least a portion of the holding portion preferably includes an annular cross-section continuing throughout an entire circumference of the holding portion and disposed on the periphery of the wiring or piping.

According to this arrangement of a preferred embodiment of the present invention, the holding portion of the bracket includes an annular portion that has an annular cross-section continuing throughout the entire circumference of the holding portion, and the wiring or the like penetrates the annular portion. The periphery of the wiring or the like is surrounded by the annular portion. Thus, the force that restrains the wiring or the like by the bracket is increased and detaching of the wiring or the like from the bracket is reliably prevented. Wearing of and damage to the wiring or the like due to sliding of the wiring or the like and another member is thus further reduced or prevented.

In a preferred embodiment of the present invention, the holding portion preferably includes a cylindrical inner peripheral surface that defines a penetration hole penetrating the coupling portion in a longitudinal direction of the wiring or piping.

According to this arrangement of a preferred embodiment of the present invention, the inner peripheral surface of the holding portion defines a penetration hole extending in the longitudinal direction of the wiring or the like, and the penetration hole penetrates the coupling portion in the longitudinal direction of the wiring or the like. The wiring or the like is inserted into the penetration hole, and a portion of the wiring or the like is disposed inside the penetration hole. Because the inner peripheral surface of the holding portion continues throughout its entire circumference, movement of the wiring or the like in the radial direction of the holding portion is reliably prevented. Further, because the inner peripheral surface of the holding portion preferably has an elongated cylindrical shape extending from one end surface of the coupling portion to another end surface of the coupling portion, movement of the wiring or the like is prevented over a longer distance in terms of the longitudinal direction of the wiring or the like. Wearing of and damage to the wiring or the like due to sliding of the wiring or the like and another member is thus further reduced or prevented.

In a preferred embodiment of the present invention, the holding portion preferably is disposed over the engine main body, and in a gap in a horizontal direction between the engine main body and the auxiliary machinery.

According to this arrangement of a preferred embodiment of the present invention, the holding portion of the bracket is disposed over the engine main body, and the holding portion and the engine main body overlap each other in a plan view. Thus, the area occupied by structural elements in a plan view is significantly reduced as compared with a case in which the holding portion and the engine main body do not overlap each other in a plan view. Further, because the holding portion of the bracket is disposed in a gap in the horizontal direction between the engine main body and the auxiliary machinery, the wiring or the like does not easily contact the engine cowling. Therefore, wearing of or damage to the wiring or the like due to sliding of the wiring or the like and the engine cowling is further reduced or prevented.

In a preferred embodiment of the present invention, the auxiliary machinery preferably includes a starter motor mounted on the engine main body via the bracket, and a ring gear that rotates together with the crankshaft by being driven to rotate by the starter motor. The holding portion preferably is disposed in a gap in a horizontal direction between the engine main body and the starter motor, and in a gap in an up-down direction between the engine main body and the ring gear.

According to this configuration of a preferred embodiment of the present invention, the holding portion of the bracket is disposed in a gap in the horizontal direction between the engine main body and the starter motor. The space in the horizontal direction between the engine main body and the starter motor is thus used as a space to dispose the holding portion. Further, the holding portion of the bracket is disposed in a gap in the up-down direction between the engine main body and the ring gear. Thus, the space in the up-down direction between the engine main body and the ring gear is also used as a space to dispose the holding portion. In this manner, because the space between the engine main body and the auxiliary machinery is effectively used, the number and size of structural elements included in the engine cowling is significantly reduced or minimized. Accordingly, an increase in a total size of the number and size of structural elements included in the engine cowling is minimized or prevented. An increase in the size of the engine cowling is thus minimized or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
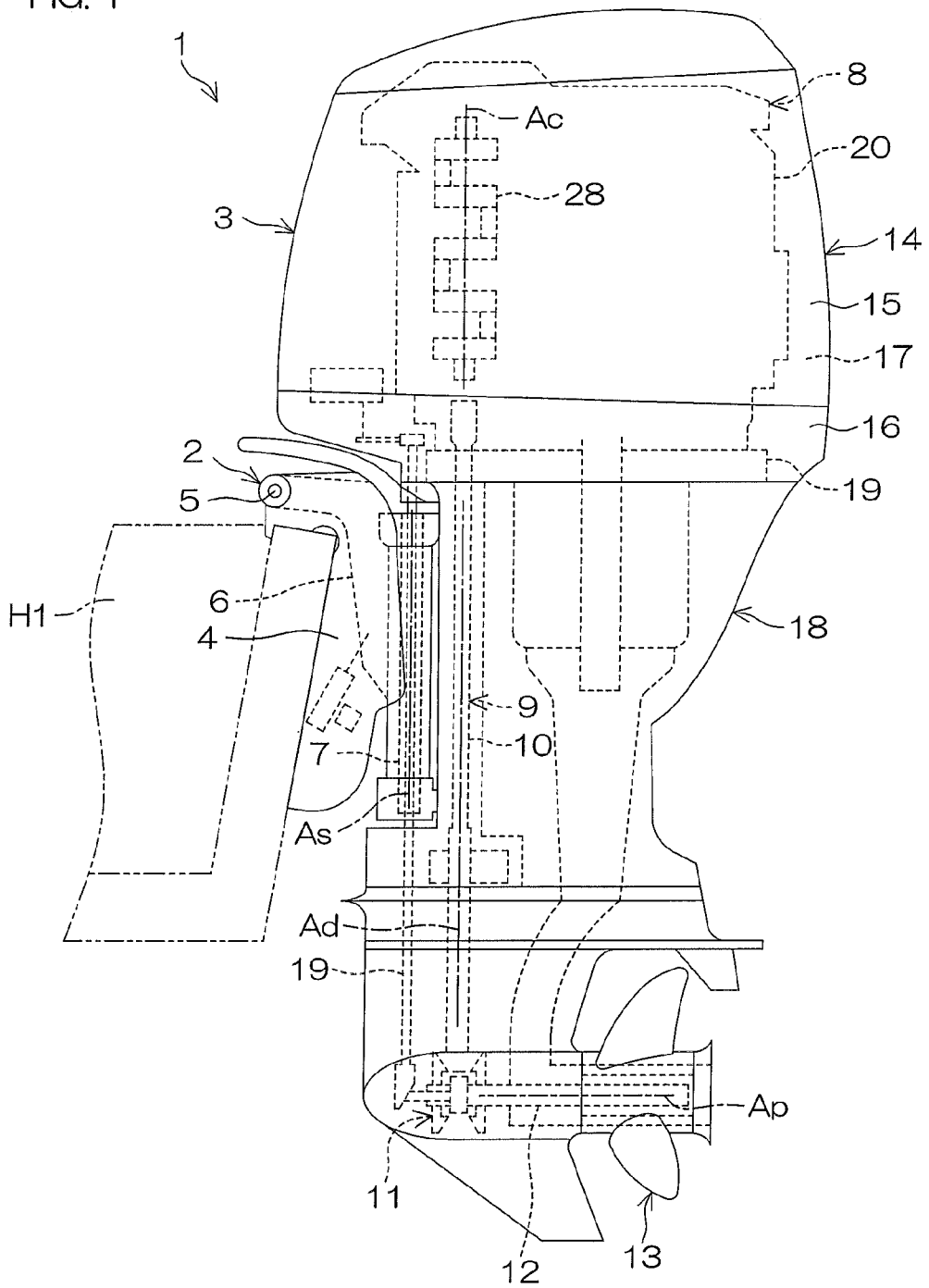
FIG. 1 is a schematic side view showing a vessel propulsion apparatus according to a first preferred embodiment of the present invention.
Figure 2:
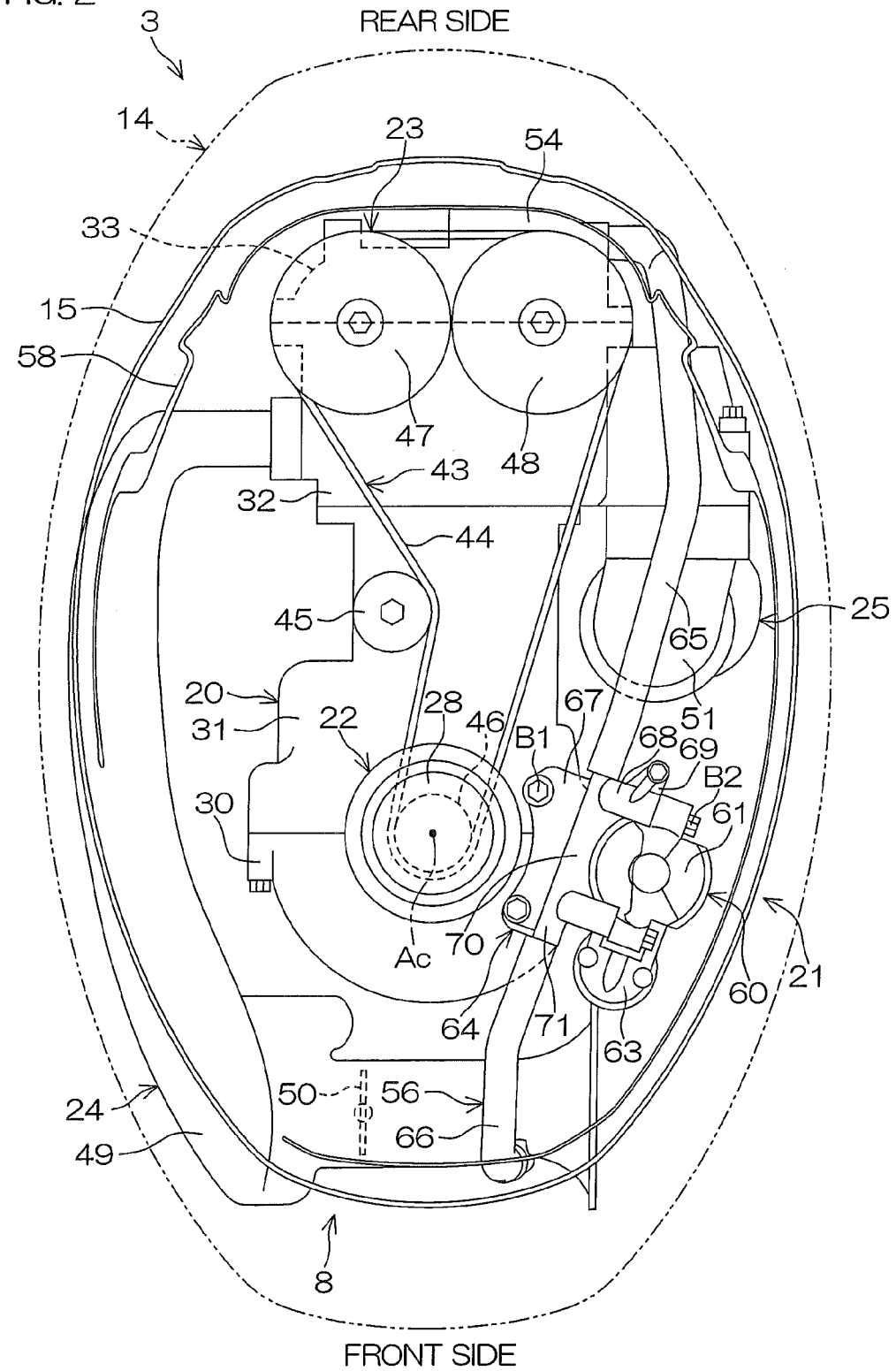
FIG. 2 is a schematic plan view showing an engine.
Figure 3:
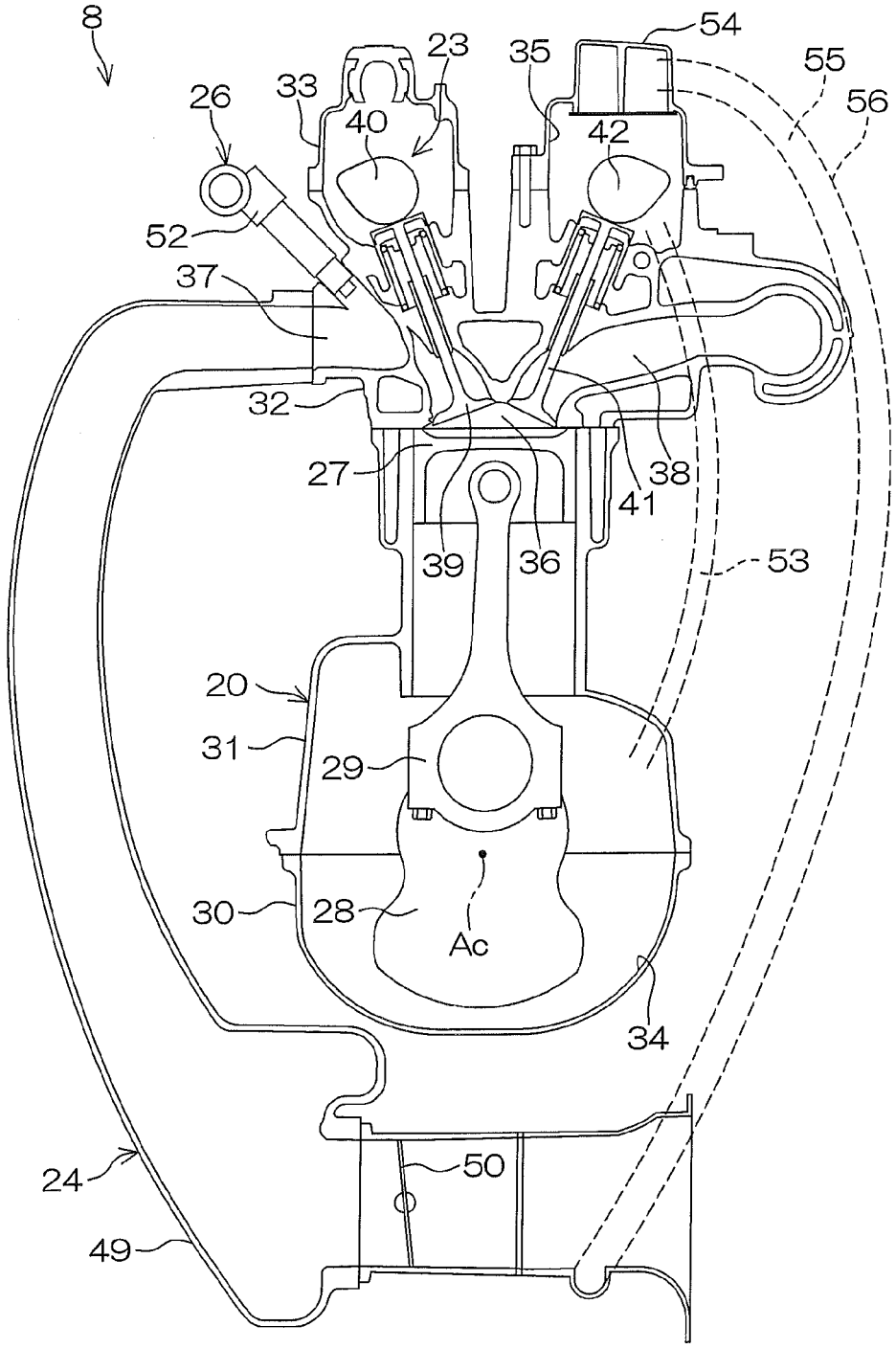
FIG. 3 is a schematic sectional view showing a schematic configuration of the engine.

FIG. 1 is a schematic side view showing a vessel propulsion apparatus 1 according to a first preferred embodiment of the present invention. FIG. 2 is a schematic plan view showing an engine 8. FIG. 3 is a schematic sectional view showing a schematic configuration of the engine 8. FIG. 2 shows a cross-section when a top cover 15 portion of an engine cowling 14 and an inner cover 58 are cut horizontally at a height equal to a mounting position of an engine main body 20 and a bracket 64 by solid lines, and shows an outer contour of the engine cowling 14 when an outboard motor 3 is observed from above by a long and two short dashed line. Further, FIG. 2 shows a state in which a flywheel 57 has been removed.

As shown in FIG. 1, the vessel propulsion apparatus 1 includes a suspension apparatus 2 mountable on a rear portion (stern) of a hull H1 and an outboard motor 3 coupled to the suspension apparatus 2.

As shown in FIG. 1, the suspension apparatus 2 includes a pair of left and right clamp brackets 4 to be mounted on the hull H1 and a tilting shaft 5 supported in a posture extending in the left-right direction on the pair of clamp brackets 4. The suspension apparatus 2 further includes a swivel bracket 6 mounted on the tilting shaft 5 and a steering shaft 7 supported in a posture extending in the up-down direction on the swivel bracket 6.

As shown in FIG. 1, the outboard motor 3 is mounted on the steering shaft 7. The steering shaft 7 is supported on the swivel bracket 6 so as to be rotatable about a steering axis As (center line of the steering shaft 7) extending in the up-down direction. The swivel bracket 6 is supported on the clamp brackets 4 via the tilting shaft 5. The swivel bracket 6 is turnable about a tilt axis (center line of the tilting shaft 5) extending in the left-right direction with respect to the clamp brackets 4. The outboard motor 3 is turnable to the left and right with respect to the hull H1, and is turnable up and down with respect to the hull H1.

As shown in FIG. 1, the outboard motor 3 includes an engine 8 that generates power to rotate a propeller 13 and a power transmission device 9 that transmits the power of the engine 8 to the propeller 13. The power transmission device 9 includes a drive shaft 10 coupled to the engine 8, a forward/reverse switching mechanism 11 coupled to the drive shaft 10, and a propeller shaft 12 coupled to the forward/reverse switching mechanism 11. The outboard motor 3 further includes an engine cowling 14 that covers the engine 8 and a casing 18 that houses the power transmission device 9.

As shown in FIG. 1, the engine cowling 14 houses the engine 8. The engine cowling 14 preferably includes a cup-shaped top cover 15 that is downwardly open and a bottom cover 16 that is upwardly open. The top cover 15 is detachably coupled to the bottom cover 16. The opening portion of the top cover 15 vertically overlaps with the opening portion of the bottom cover 16 via a seal (not shown). The bottom cover 16 and the top cover 15 define an engine housing space 17 that houses the engine 8. The casing 18 includes an exhaust guide 19 on which the engine 8 is mounted. The bottom cover 16 is mounted on the exhaust guide 19. The exhaust guide 19, defining and serving as an engine support member, supports the engine 8 in a posture that a rotation axis (crank axis Ac) of the engine 8 is vertical or substantially vertical.

As shown in FIG. 1, the engine 8 is disposed over the drive shaft 10. The drive shaft 10 extends in the up-down direction inside the casing 18. A center line of the drive shaft 10 may be disposed on the rotation axis of the engine 8, and may be shifted with respect to the rotational axis of the engine 8. An upper end portion of the drive shaft 10 is coupled to the engine 8, and a lower end portion of the drive shaft 10 is coupled to the propeller shaft 12 via the forward/reverse switching mechanism 11. The propeller shaft 12 extends in the front-rear direction inside the casing 18. A rear end portion of the propeller shaft 12 projects rearward from the casing 18. The propeller 13 is removably mounted on the rear end portion of the propeller shaft 12. The propeller 13 is rotatable about a propeller axis Ap (center line of the propeller shaft 12) together with the propeller shaft 12.

The engine 8 is preferably an internal combustion engine. The engine 8 rotates in a fixed rotation direction. The rotation of the engine 8 is transmitted to the propeller 13 by the power transmission device 9. The propeller 13 is thus caused to rotate together with the propeller shaft 12 and a thrust that propels the vessel forward or in reverse is generated. Also, the direction of a rotation transmitted from the drive shaft 10 to the propeller shaft 12 is switched by the forward/reverse switching mechanism 11. The rotation direction of the propeller 13 and the propeller shaft 12 is thus switched between a normal rotation direction (clockwise direction when the propeller 13 is viewed from the rear) and a reverse rotation direction (direction of rotation opposite to the normal rotation direction). The direction of thrust is thus switched.

As shown in FIG. 3, the engine 8 includes an engine main body 20 including a plurality of cylinders and auxiliary machinery to assist the engine 8. The engine 8 is preferably a multi-cylinder in-line engine. The engine 8 is not limited to an in-line engine, and may be a V-type engine, or may be an engine of a type other than the in-line and V-type engines. Also, the engine 8 is not limited to being a multi-cylinder engine and may instead be a single-cylinder engine, for example.

As shown in FIG. 2, the auxiliary machinery includes a starting device 21 that starts the engine main body 20 and an electrical power generator 22 that converts the power of the engine main body 20 to electrical power. The auxiliary machinery further includes a valve device 23 that opens and closes an air intake port 37 and an exhaust port 38 (refer to FIG. 3), an intake device 24 that supplies air to a combustion chamber 36 (refer to FIG. 3), and an exhaust device 25 that discharges exhaust generated in the combustion chamber 36. As shown in FIG. 3, the auxiliary machinery further includes a fuel supply device 26 that supplies fuel to the combustion chamber 36. Besides the above, the auxiliary machinery includes a cooling device that cools the engine main body 20 and an ignition device that causes combustion of a mixture gas of air and fuel in the combustion chamber 36.

As shown in FIG. 3, the engine main body 20 includes a plurality of pistons 27 respectively disposed inside the plurality of cylinders, a crankshaft 28 that is rotatable about the crank axis Ac extending in the up-down direction, and a plurality of connecting rods 29 that couple each of the plurality of pistons 27 to the crankshaft 28. The engine main body 20 further includes a cylinder body 31 that houses the plurality of pistons 27, a cylinder head 32 that defines the plurality of cylinders together with the cylinder body 31, a head cover 33 that covers the cylinder head 32, and a crank case 30 that houses the crankshaft 28 together with the cylinder body 31.

As shown in FIG. 3, the crank case 30, the cylinder body 31, the cylinder head 32, and the head cover 33 are aligned in the front-rear direction in this order from the front. The cylinder head 32 and the crank case 30 are mounted on the cylinder body 31, and are disposed on mutually opposite sides with respect to the cylinder body 31. The head cover 33 is mounted on the cylinder head 32. The crank case 30 and the cylinder body 31 define a crank chamber 34 to house the crankshaft 28 between the crank case 30 and the cylinder body 31. The cylinder head 32 and the head cover 33 define a cam chamber 35 to house an intake cam shaft 40 and an exhaust cam shaft 42 between the cylinder head 32 and the head cover 33.

As shown in FIG. 3, the engine main body 20 includes a plurality of combustion chambers 36 defined by the cylinder head 32, a plurality of intake ports 37 that guide intake air to be supplied to the plurality of combustion chambers 36, and a plurality of exhaust ports 38 that guide exhaust generated in the plurality of combustion chambers 36. Each intake port 37 and each exhaust port 38 open to an outer surface of the engine main body 20, and extend from the outer surface of the engine main body 20 to the inner surface of the corresponding combustion chamber 36. The valve device 23 includes a plurality of intake valves 39 that open and close the plurality of intake ports 37, an intake cam shaft 40 that moves the intake valve 39 between a closed position and an open position, a plurality of exhaust valves 41 that open and close the plurality of exhaust ports 38, and an exhaust cam shaft 42 that moves the exhaust valve 41 between a closed position and an open position.

As shown in FIG. 2, the valve device 23 includes a cam drive device 43 that transmits a rotation of the crankshaft 28 to the intake cam shaft 40 and the exhaust cam shaft 42. The cam drive device 43 includes a plurality of timing gears, a timing belt 44 wound around the plurality of timing gears, and a tensioner 45 that provides tension to the timing belt 44. The plurality of timing gears include a driving gear 46 that rotates about the crank axis Ac together with the crankshaft 28, a first driven gear 47 that rotates about a center line of the intake cam shaft 40 together with the intake cam shaft 40, and a second driven gear 48 that rotates about a center line of the exhaust cam shaft 42 together with the exhaust cam shaft 42. The driving gear 46, the first driven gear 47, and the second driven gear 48 are disposed over the crankshaft 28, the intake cam shaft 40, and the exhaust cam shaft 42, respectively.

As shown in FIG. 3, the intake device 24 includes an intake pipe 49 that supplies air to the plurality of combustion chambers 36 via the plurality of intake ports 37 and a throttle valve 50 that adjusts the flow rate of air supplied from the intake pipe 49 to the plurality of combustion chambers 36. As shown in FIG. 2, the exhaust device 25 includes an exhaust pipe 51 that guides exhaust discharged from the plurality of combustion chambers 36 via the plurality of exhaust ports 38. The intake pipe 49 and the exhaust pipe 51 are mounted to the cylinder head 32. The interior of the intake pipe 49 is connected to each intake port 37, and the interior of the exhaust pipe 51 is connected to each exhaust port 38. The intake ports 37 and the intake pipe 49 define a portion of an intake passage that guides air to the combustion chambers 36, and the exhaust ports 38 and the exhaust pipe 51 define a portion of an exhaust passage that guides exhaust discharged from the combustion chambers 36.

As shown in FIG. 3, the fuel supply device 26 includes a plurality of fuel injectors 52 that supply fuel to the plurality of combustion chambers 36. The fuel injectors 52 are provided for each of the combustion chambers 36. The injection amount of fuel from each fuel injector 52 is adjusted by an ECU (Electronic Control Unit) that controls the engine 8. A fuel outlet of the fuel injector 52 that injects fuel is disposed inside the intake port 37. The fuel outlet is thus disposed in the intake passage. The fuel outlet may instead be disposed inside the intake pipe 49 or inside the combustion chamber 36.

As shown in FIG. 3, the outboard motor 3 includes a first blowby gas passage 53 that guides a blowby gas having flowed into the crank chamber 34 (gas that has leaked out of the combustion chamber 36 through a gap between the cylinder and piston 27) to the cam chamber 35. The outboard motor 3 further includes a gas-liquid separator (oil separator) 54 that separates a liquid component from a blowby gas that has flowed into the cam chamber 35, and a second blowby gas passage 55 that guides a blowby gas from the gas-liquid separator 54 to the intake device 24. The gas-liquid separator 54 is defined by the head cover 33. The interior of the gas-liquid separator 54 is connected to the interior of the cam chamber 35 so that a fluid can move in and out of the interior of the gas-liquid separator 54 and the interior of the cam chamber 35. The first blowby gas passage 53 extends from the cylinder body 31 to the cylinder head 32, and the second blowby gas passage 55 extends from the head cover 33 to the intake pipe 49. A portion of the second blowby gas passage 55 is defined by a blowby hose 56.

Figure 4:
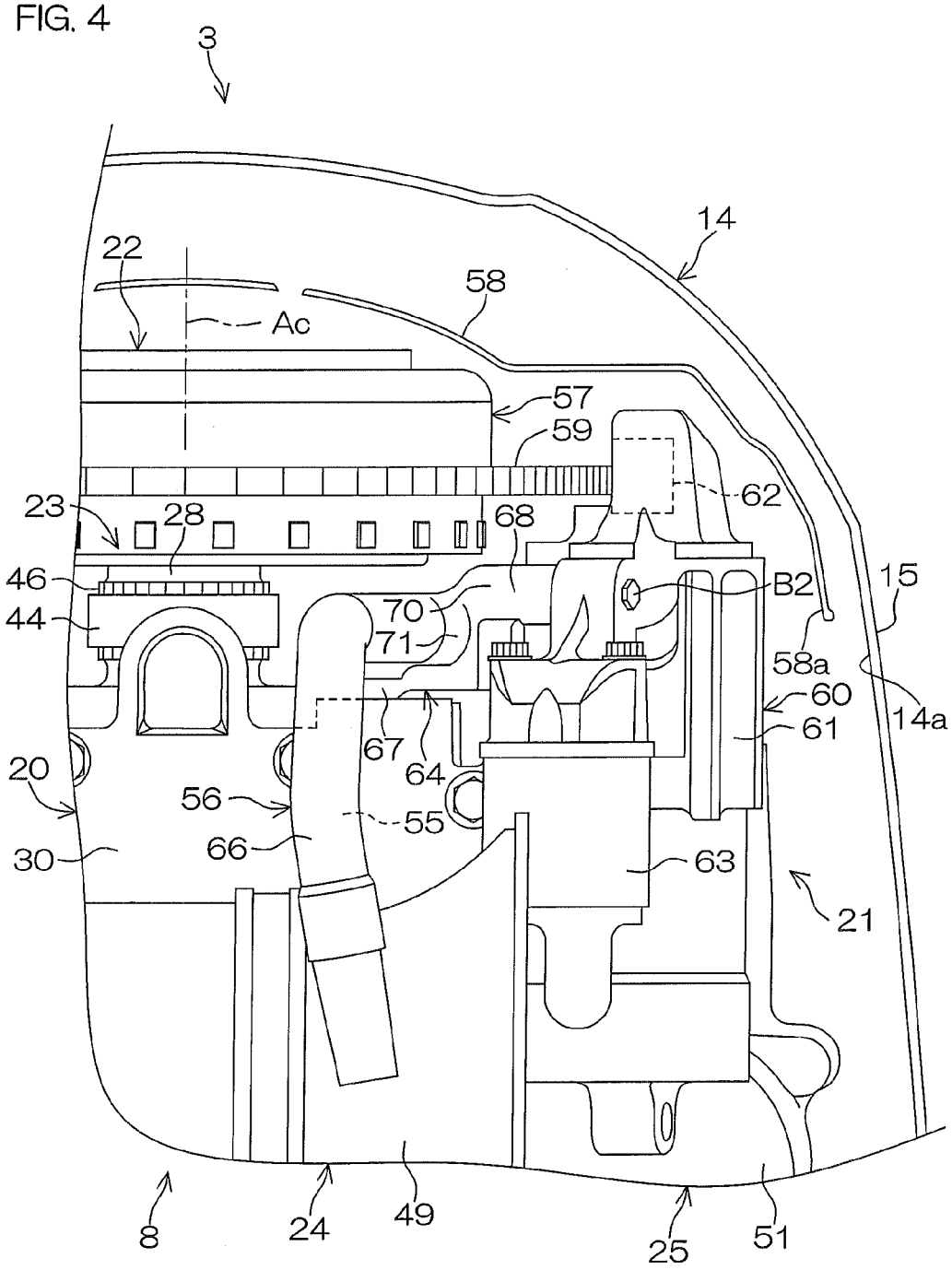
FIG. 4 is a schematic front view showing a starting device.
Figure 5:
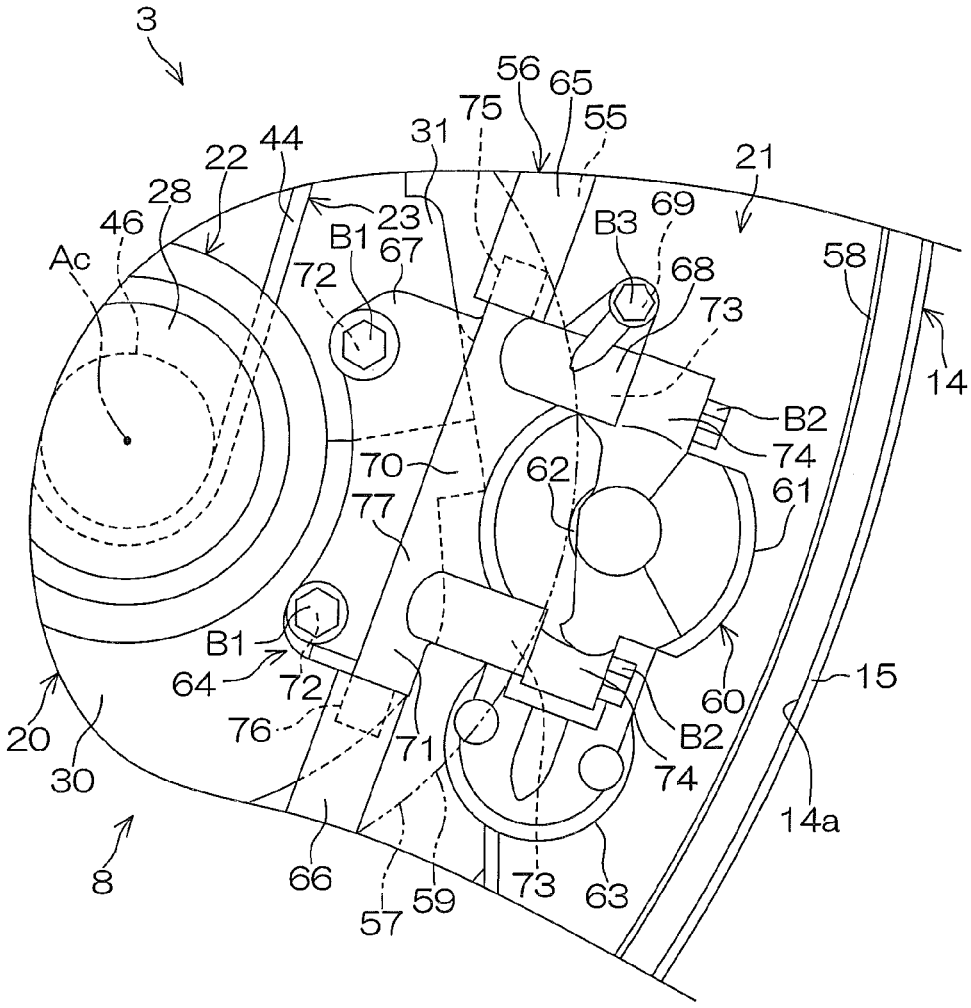
FIG. 5 is a schematic plan view showing the starting device.

FIG. 4 is a schematic front view showing the starting device 21. FIG. 5 is a schematic plan view showing the starting device 21.

As shown in FIG. 4, the engine main body 20 includes a disk-shaped flywheel 57 that rotates about the crank axis Ac together with the crankshaft 28. The outboard motor 3 includes an inner cover 58 that covers a movable portion such as the flywheel 57 inside the engine cowling 14. The inner cover 58 is disposed inside the engine cowling 14. The flywheel 57 and the timing gears are disposed under the inner cover 58. The driving gear 46 of the timing gears is disposed under the flywheel 57. The flywheel 57 is integral with a portion of the power generator 22. That is, the engine 8 includes a disk-shaped flywheel magneto for which a portion of the power generator 22 and the flywheel 57 are integral.

As shown FIG. 5, the flywheel 57 is disposed over the crank case 30 and the cylinder body 31. The flywheel 57 is coupled such that a center line of the flywheel 57 is located on the crank axis Ac. The flywheel 57 and the crankshaft 28 integrally rotate about the crank axis Ac. The power generator 22 includes an annular rotor fixed to the flywheel 57 and an annular stator fixed to the crank case 30 and the cylinder body 31. When the crankshaft 28 rotates, the flywheel 57 rotates with respect to the crank case 30 and the cylinder body 31, and the rotor and stator of the power generator 22 rotate relatively. A rotation of the engine 8 is thus converted to electrical power by the power generator 22.

As shown in FIG. 4, the starting device 21 includes a ring gear 59 defining and serving as a driven gear provided at an outer peripheral portion of the flywheel 57 and a starter unit 60 that rotates the crankshaft 28 about the crank axis Ac by rotating the ring gear 59. The ring gear 59 and the starter unit 60 are disposed in the interior of the engine cowling 14. The starter unit 60 is disposed laterally of the engine main body 20. The starter unit 60 is disposed under the inner cover 58. A lower end portion 58*a* of the inner cover 58 is disposed on the periphery of the starter unit 60.

As shown in FIG. 4, the starter unit 60 includes a starter motor 61 that rotates the ring gear 59 and a magnet switch 63 that causes transmission of a rotation of the starter motor 61 to the ring gear 59 in response to an operation of a starter switch (not shown). The starter motor 61 includes a pinion 62 defining and serving as a driving gear to engage with the ring gear 59, a rotor that rotates together with the pinion 62, and a stator that rotates the rotor by an electromagnetic force.

As shown in FIG. 4, the starter motor 61 is kept in a posture such that a rotation axis of the starter motor 61 extends in the up-down direction. The pinion 62 is disposed at an upper end portion of the starter motor 61 such that a rotation axis of the pinion 62 is located on the rotation axis of the starter motor 61. The pinion 62 rotates about the rotation axis of the starter motor 61 together with a rotating shaft of the starter motor 61. The magnet switch 63 is disposed on the periphery of the starter motor 61. The magnet switch 63 is disposed in front of the starter motor 61. The starter motor 61 and the magnet switch 63 are thus aligned in the front-rear direction.

The pinion 62 is movable up and down between an engaged position where the pinion 62 engages with the ring gear 59 (position shown in FIG. 4) and a retracted position where the pinion 62 disengages from the ring rear 59. When the starter switch has not been operated by a user, the pinion 62 is disposed at the retracted position. When the starter switch is operated by a user, the magnet switch 63 supplies electrical power from a battery to the starter motor 61 and moves the pinion 62 to the engaged position. A rotation of the starter motor 61 is thus transmitted to the ring gear 59 via the pinion 62, and the crankshaft 28 rotates about the crank axis Ac. As a result, the engine 8 is started.

Figure 6:
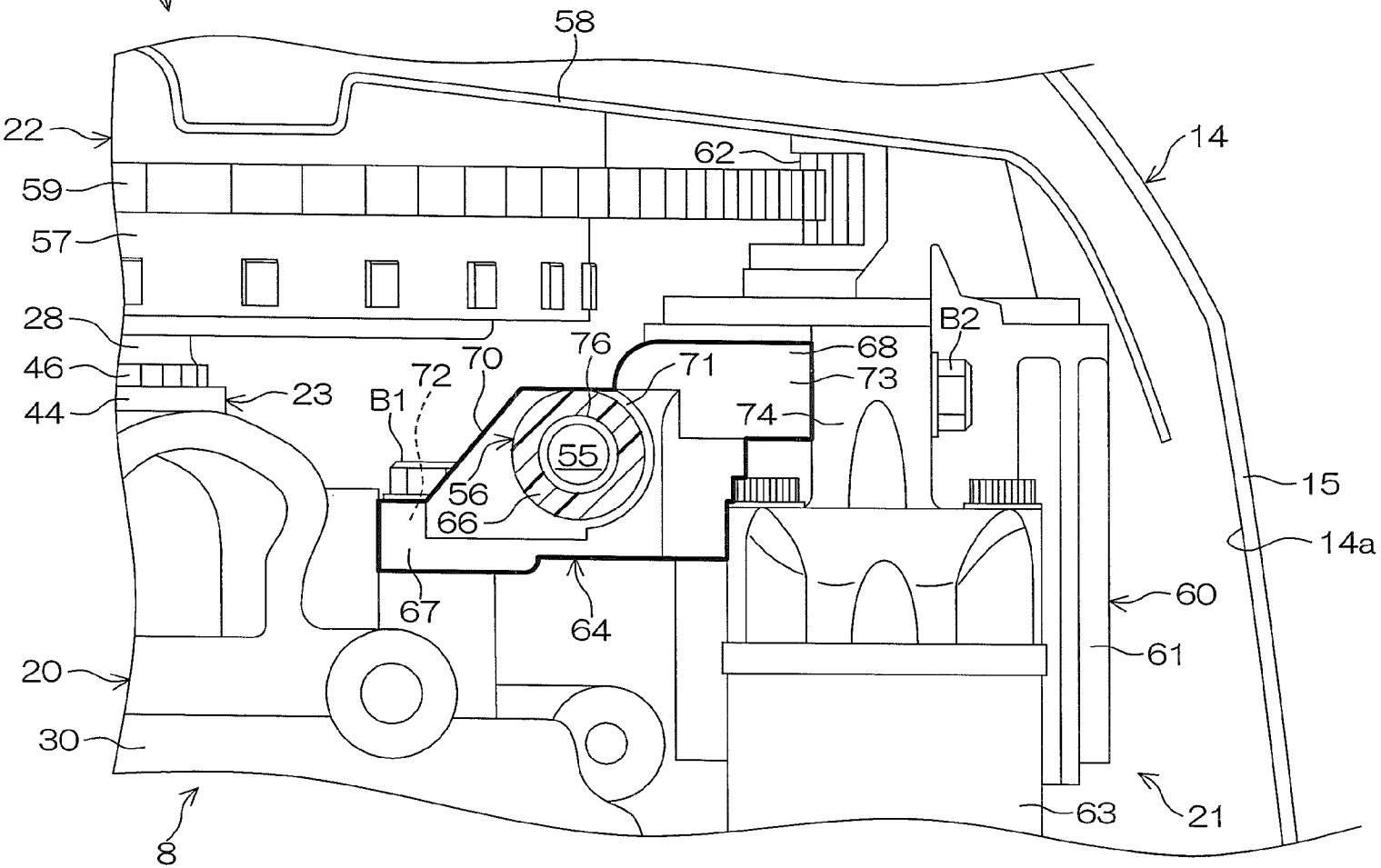
FIG. 6 is a schematic front view showing a bracket to couple a starter motor to an engine main body.
Figure 7A:
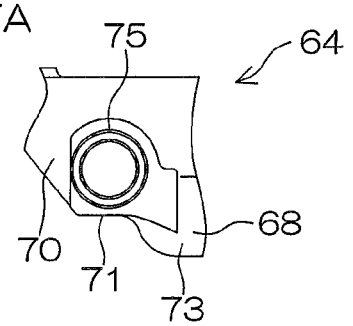
FIG. 7A is a view of the bracket shown in FIG. 7B observed from an upper side of FIG. 7B.
Figure 7B:
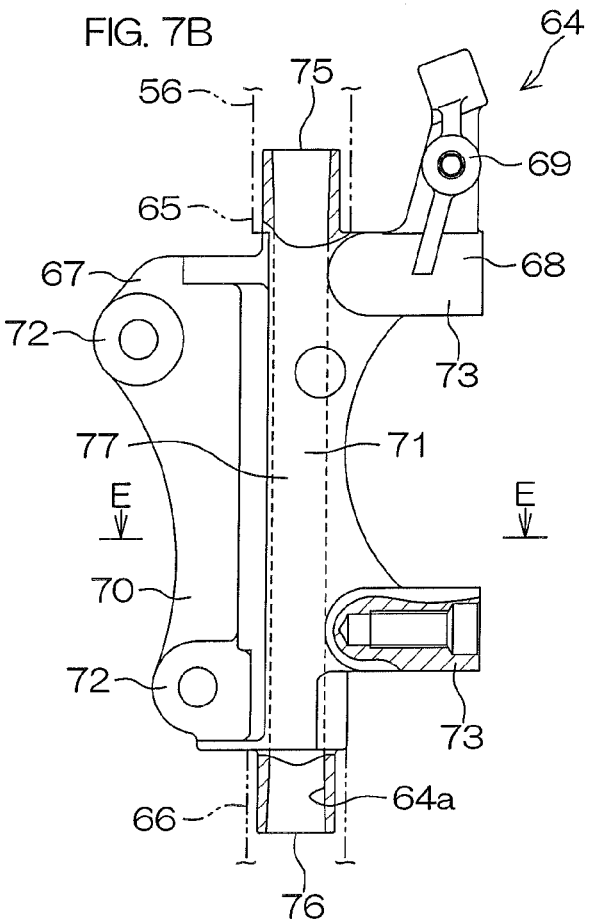
FIG. 7B is a plan view of the bracket.
Figure 7D:
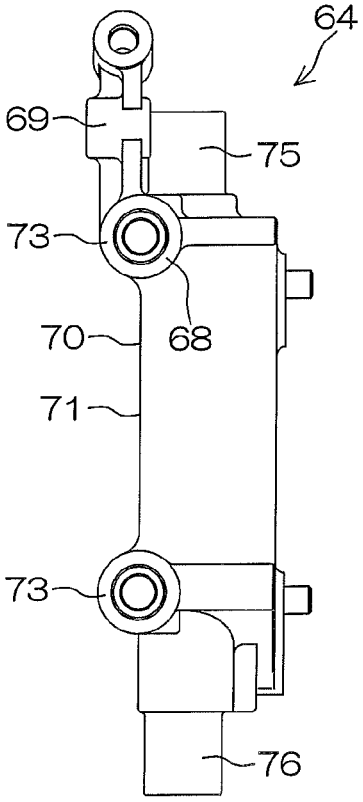
FIG. 7D is a view of the bracket shown in FIG. 7B observed from the right side of FIG. 7B.
Figure 7C:
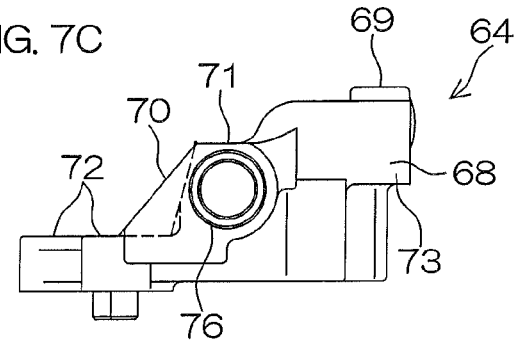
FIG. 7C is a view of the bracket shown in FIG. 7B observed from a lower side of FIG. 7B.
Figure 7E:
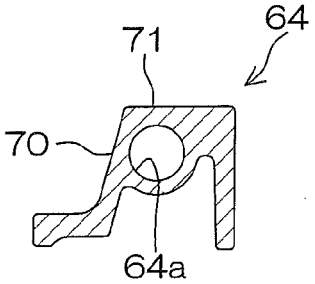
FIG. 7E is a sectional view of the bracket taken along line E-E shown in FIG. 7B.

FIG. 6 is a schematic front view showing the bracket 64 to couple the starter motor 61 to the engine main body 20. In FIG. 6, the contour of the bracket 64 is shown by a thick line. FIG. 7A is a view of FIG. 7B observed from the upper side of FIG. 7B. FIG. 7B is a plan view of the bracket 64. FIG. 7C is a view of FIG. 7B observed from the lower side of FIG. 7B. FIG. 7D is a view of FIG. 7B observed from the right side of FIG. 7B. FIG. 7E is a sectional view of the bracket 64 taken along line E-E shown in FIG. 7B.

As shown in FIG. 2, the engine 8 includes a bracket 64 to mount the starter unit 60 on the engine main body 20.

As shown in FIG. 2, the bracket 64 holds the blowby hose 56. The bracket 64 thus mounts the auxiliary machinery on the engine main body 20 and holds the piping. The blowby hose 56 includes a first piping 65 extending to the bracket 64 from the head cover 33 and a second piping 66 extending to the intake pipe 49 from the bracket 64. The first piping 65 and the second piping 66 are made of, for example, a flexible resin, and the bracket 64 is made of, for example, a metal (specifically, aluminum alloy). The bracket 64 is thus made of a material higher in strength than the blowby hose 56.

As shown in FIG. 5 and FIG. 6, the bracket 64 is preferably disposed in a gap in the horizontal direction between the engine main body 20 and the starter unit 60. The bracket 64 is preferably disposed lower than the ring gear 59 provided on the flywheel 57. The bracket 64 is preferably disposed in a gap in the up-down direction between the engine main body 20 and the ring gear 59. The bracket 64 is disposed farther inward than the starter unit 60 with respect to an inner surface 14*a* of the engine cowling 14. The distance from the inner surface 14*a* of the engine cowling 14 to the bracket 64 is longer than the distance from the inner surface 14*a* of the engine cowling 14 to the starter unit 60.

As shown in FIG. 5, the bracket 64 includes a first mounting portion 67 mounted on the engine main body 20, a second mounting portion 68 mounted on the starter unit 60, a third mounting portion 69 mounted on the inner cover 58, a coupling portion 70 that couples the first mounting portion 67 and the second mounting portion 68, and a holding portion 71 provided in the coupling portion 70. The first mounting portion 67, the second mounting portion 68, the third mounting portion 69, the coupling portion 70, and the holding portion 71 are preferably integral with each other.

As shown in FIG. 5, the first mounting portion 67, the coupling portion 70, and the holding portion 71 are disposed over the engine main body 20. The first mounting portion 67 is removably mounted on the engine main body 20 by, for example, first bolts B1 defining and serving as first mounting members. The coupling portion 70 and the holding portion 71 are disposed outward of the first mounting portion 67, and the second mounting portion 68 is disposed outward of the coupling portion 70 and the holding portion 71. The second mounting portion 68 is removably mounted on the starter unit 60 by, for example, second bolts B2 defining and serving as second mounting members. The third mounting portion 69 projects from the second mounting portion 68 horizontally. The third mounting portion 69 is coupled to the second mounting portion 8. The third mounting portion 69 is disposed behind the starter unit 60. The third mounting portion 69 is removably attached to the inner cover 58 by, for example, a third bolt B3 defining and serving as a third mounting member.

As shown in FIG. 7B, the first mounting portion 67 includes two first bolt mounting portions 72 provided with through-holes into which first bolts B1 are inserted. As shown in FIG. 5, one first bolt mounting portion 72 is disposed over the crank case 30, and another first bolt mounting portion 72 is disposed over the cylinder body 31. The first bolt B1 is inserted into the first bolt mounting portion 72 from above in a posture extending vertically. The first bolt B1 has a male screw shaft that is screwed to a female screw hole provided in the engine main body 20, and the first bolt B1 has a head portion disposed over the bracket 64. The two first bolt mounting portions 72 are, by the two first bolts B1, respectively fixed to the crank case 30 and the cylinder body 31.

As shown in FIG. 7B, the second mounting portion 68 includes two second bolt mounting portions 73 provided with female screw holes to which male screw shafts of the second bolts B2 are screwed. The second bolt mounting portions 73 extend outward from the coupling portion 70. The two second bolt mounting portions 73 are disposed parallel or substantially parallel to each other. As shown in FIG. 5, the starter unit 60 is disposed in a portion between the two second bolt mounting portions 73 in a plan view. The starter unit 60 includes two third bolt mounting portions 74 respectively provided with two through-holes. The two third bolt mounting portions 74 are disposed outward of the two second bolt mounting portions 73, respectively. The two third bolt mounting portions 74 are laid on each other such that their two through-holes respectively face the two female holes. The second bolt B2 is inserted into the third bolt mounting portion 74 from the outside in a posture extending horizontally. The second bolt B2 includes a head portion disposed outward of the starter unit 60. The two third bolt mounting portions 74 are, by the two second bolts B2, respectively fixed to the two second bolt mounting portions 73 by the two second bolts B2.

As shown in FIG. 7B, the holding portion 71 includes a cylindrical first piping mounting portion 75 in which the first piping 65 is mounted, a cylindrical second piping mounting portion 76 in which the second piping 66 is mounted, and a cylindrical intermediate portion 77 extending from the first piping mounting portion 75 to the second piping mounting portion 76. The bracket 64 includes an inner peripheral surface 64*a* that defines a penetration hole as a relay passage extending from the interior of the first piping 65 to the interior of the second piping 66. The penetration hole is opened at tip end surfaces of the first piping mounting portion 75 and the second piping mounting portion 76, and penetrates the first piping mounting portion 75, the second piping mounting portion 76, and the intermediate portion 77 horizontally. The penetration hole defines a portion of the second blowby gas passage 55. The inner peripheral surface 64*a* of the bracket 64 thus defines a portion of the second blowby gas passage 55. Therefore, a blowby gas in the first piping 65 flows into the second piping 66 through the interior of the bracket 64, and is guided into the intake pipe 49 by the second piping 66.

As described above, in the present preferred embodiment, the crankshaft 28 that is rotatable about the crank axis Ac extending in the up-down direction is provided in the engine main body 20. The engine main body 20 is disposed inside the engine cowling 14. Similarly, the starter unit 60, as an example of the auxiliary machinery, and the bracket 64, to mount the starter unit 60 on the engine main body 20, are disposed inside the engine cowling 14. The first mounting portion 67 of the bracket 64 is mounted on the engine main body 20, and the second mounting portion 68 of the bracket 64 is mounted on the starter unit 60. The starter unit 60 is thus coupled to the engine main body 20.

The bracket 64 holds the blowby hose 56, as an example of piping, by the holding portion 71 provided in the coupling portion 70 that couples the first mounting portion 67 and the second mounting portion 68. That is, the bracket 64 not only mounts the starter unit 60 on the engine main body 20, but also holds the blowby hose 56. Thus, as compared with a case of providing a bracket for the blowby hose 56 in addition to a bracket for the starter unit 60, the number and size of structural elements included in the engine cowling 14 is significantly reduced or minimized. The engine cowling 14 is thus downsized. Further, even when the engine main body 20 is increased in size, an increase in the number and size of structural elements included in the engine cowling as a whole is minimized or prevented, so that an increase in the size of the engine cowling 14 is minimized or prevented.

Also, in the present preferred embodiment, the distance from the inner surface 14*a* of the engine cowling 14 to the holding portion 71 of the bracket 64 preferably is longer than the distance from the inner surface 14*a* of the engine cowling 14 to the starter unit 60. The holding portion 71 of the bracket 64 is thus disposed farther inward than the starter unit 60 with respect to the inner surface 14*a* of the engine cowling 14. Therefore, hindering the downsizing of the engine cowling 14 by interference of the blowby hose 56 and the engine cowling 14 is avoided. Further, contact of the blowby hose 56 with the engine cowling 14 due to an outward movement of the blowby hose 56 resulting from an increase in the size of the engine main body 20 is prevented. An increase in the size of the engine cowling 14 is thus minimized or prevented.

Also, in the present preferred embodiment, the holding portion 71 of the bracket 64 is disposed over the engine main body 20, and the holding portion 71 and the engine main body 20 overlap each other in a plan view. Thus, the area occupied by the structural elements contained in the engine cowling in a plan view is significantly reduced as compared with a case in which the holding portion 71 and the engine main body 20 do not overlap each other in a plan view. Further, because the holding portion 71 of the bracket 64 is preferably disposed in a gap in the horizontal direction between the engine main body 20 and the starter unit 60, the blowby hose 56 does not easily contact the engine cowling 14. Therefore, wearing of and damage to the blowby hose 56 due to sliding of the blowby hose 56 and the engine cowling 14 is reduced or prevented.

Also, in the present preferred embodiment, the holding portion 71 of the bracket 64 is preferably disposed in a gap in the horizontal direction between the engine main body 20 (crank case 30 and cylinder body 31) and the starter motor 61. The space in the horizontal direction between the engine main body 20 and the starter motor 61 is thus used as a space to dispose the holding portion 71. Further, the holding portion 71 of the bracket 64 is disposed in a gap in the up-down direction between the engine main body 20 (crank case 30 and cylinder body 31) and the ring gear 59. Thus, the space in the up-down direction between the engine main body 20 and the ring gear 59 is also used as a space to dispose the holding portion 71. In this manner, because the space between the engine main body 20 and the starter unit 60 is effectively used, the number and size of structural elements included in the engine cowling 14 are significantly reduced or minimized. Accordingly, an increase in the overall size of the area occupied by the structural elements in the engine cowling 14 as a whole is minimized or prevented. An increase in the size of the engine cowling 14 is thus minimized or prevented.

Also, in the present preferred embodiment, the first piping 65 and the second piping 66 that define a common passage (second blowby gas passage 55) are preferably mounted in the first piping mounting portion 75 and the second piping mounting portion 76 of the bracket 64, respectively. The inner peripheral surface 64*a* of the bracket 64 defines a penetration hole as a relay passage extending from the interior of the first piping 65 to the interior of the second piping 66. That is, the bracket 64 not only holds the first piping 65 and the second piping 66, but also defines a common passage with the first piping 65 and the second piping 66.

In this manner, the bracket 64 itself defines a passage, and therefore, the length of the blow by hose 56 is significantly reduced. The number and size of structural elements included in the engine cowling 14 is thus significantly reduced or minimized. Further, because the length of the blowby hose 56 is reduced, displacement of the blowby hose 56 by vibration is reduced or prevented. A positional change of the blowby hose 56 is thus prevented. Moreover, because the blowby hose 56 is mounted on the bracket 64 that is higher in rigidity than the blowby hose 56 and the bracket 64 is mounted on the engine main body 20, displacement of the blowby hose 56 is further reduced or prevented. Wearing of and damage to the blowby hose 56 due to sliding of the blowby hose 56 and another member is thus further reduced or prevented.

Although preferred embodiments of the present invention have been described above, the present invention is not restricted to the contents of the preferred embodiments and various modifications are possible within the scope of the present invention.

For example, in the above-described preferred embodiments, a description has been given of a case in which the blowby hose 56 preferably includes double piping (first piping 65 and second piping 66), for example. However, the blowby hose 56 may include triple or more piping, or may be of single piping.

Also, in the above-described preferred embodiments, a description has been given of a case where the bracket 64 preferably holds the blowby hose 56 as an example of piping. However, the bracket 64 may hold piping other than the blowby hose 56 or may hold wiring such as a wire harness. Alternatively, the bracket 64 may hold both wiring and piping.

Also, in the above-described preferred embodiments, a description has been given of a case where the blowby hose 56 is preferably disposed farther inward than the starter unit 60. However, the blowby hose 56 may be disposed farther outward than the starter unit 60 with respect to the inner surface 14*a* of the engine cowling 14.

Also, the bracket 64 may be coupled with electric auxiliary machinery such as an ECU, not the starter unit 60.

Also, in the above-described preferred embodiments, a description has been given of a case where the bracket 64 and the ring gear 59 preferably overlap each other in a plan view. However, the bracket 64 may be disposed so as not to overlap the ring gear 59 in a plan view.

Also, in the above-described preferred embodiments, a description has been given of a case where the bracket 64 is preferably a member separate from the engine main body 20 and the starter unit 60. However, the bracket 64 may be integral with a portion or a whole of the starter unit 60.

Also, in the above-described preferred embodiments, a description has been given of a case where the bracket 64 is preferably coupled to both of the crank case 30 and the cylinder body 31 by the two first bolts B1. However, the bracket 64 may be coupled to one of the crank case 30 and the cylinder body 31 or may be coupled to components of the engine main body 20 other than the crank case 30 and the cylinder body 31.

Also, in the above-described preferred embodiments, a description has been given of a case where the bracket 64 is preferably coupled to the engine main body 20 at two mounting positions spaced apart in the horizontal direction and coupled to the auxiliary machinery (starter unit 60) at two mounting positions spaced apart in the horizontal direction. However, the bracket 64 may be coupled to the engine main body 20 at a plurality of mounting positions spaced apart in the up-down direction. Similarly, the bracket 64 may be coupled to the auxiliary machinery at a plurality of mounting positions spaced apart in the up-down direction.

Figure 11:
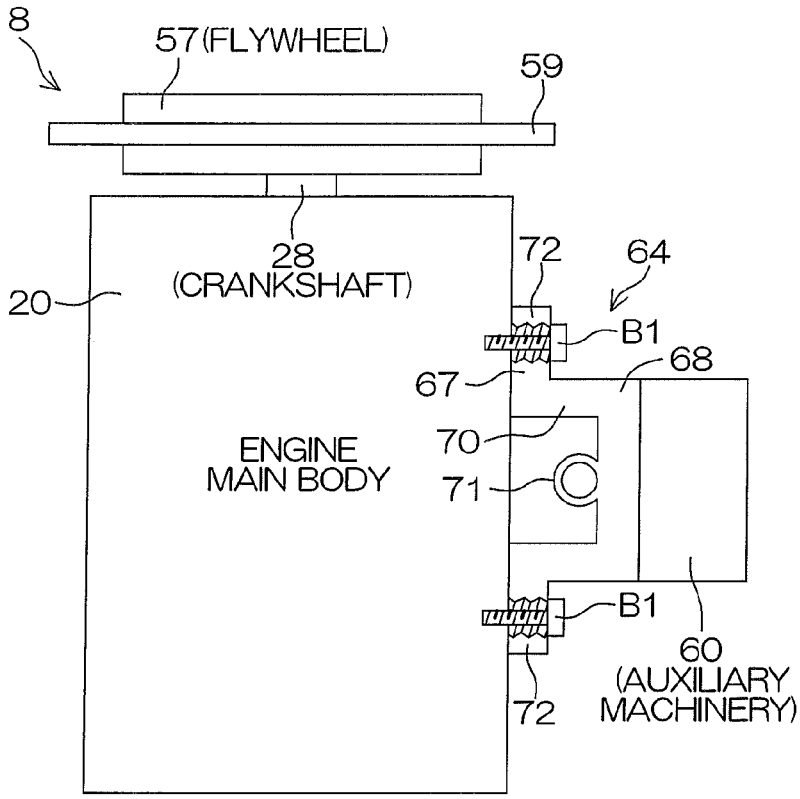
FIG. 11 is a schematic view showing another example of how the bracket may be disposed.
Figure 12:
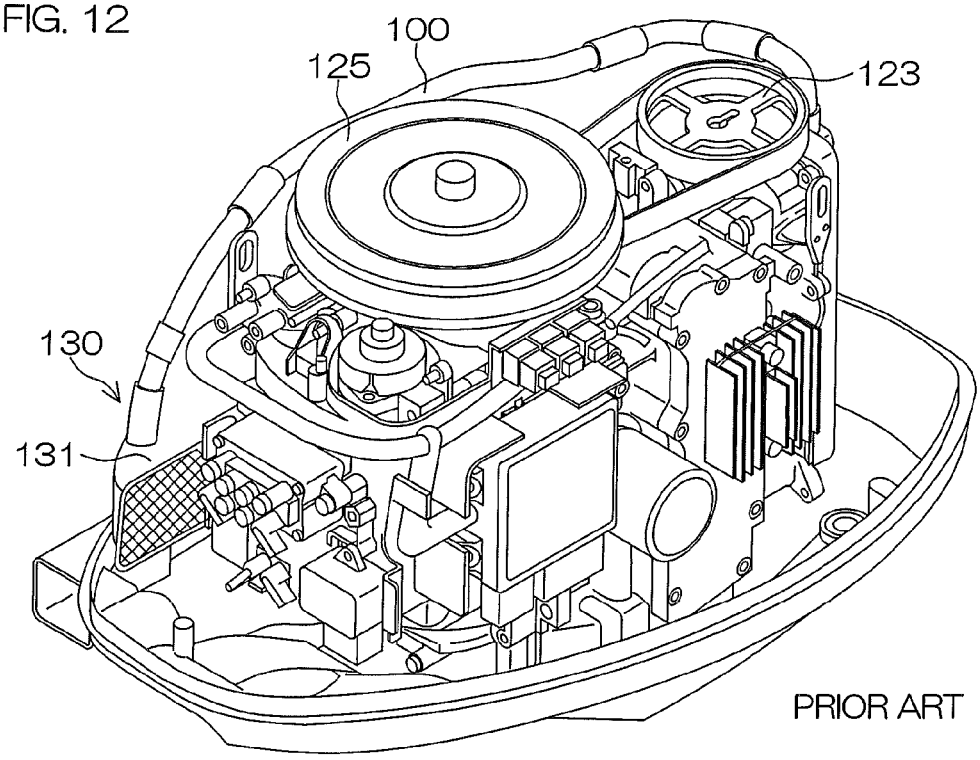
FIG. 12 is a perspective view showing an engine of a conventional outboard motor.

Specifically, as shown in FIG. 11, the entire bracket 64 may be disposed on the periphery of the engine main body 20, and the two first bolt mounting portions 72 of the bracket 64 may be coupled to the engine main body 20 preferably by the two first bolts B1, for example, at two mounting positions spaced apart in the up-down direction. In this case, the holding portion 71 that holds wiring or piping may be disposed over a portion or the whole distance between the two first bolt mounting portions 72, for example. Also, the auxiliary machinery 60 may be disposed on the periphery of the bracket 64, or may be disposed over or under the bracket 64.

Also, in the above-described preferred embodiments, a description has been given of a case where the blowby hose 56 is preferably held by the bracket 64 between a connecting position (first connecting position) of the blowby hose 56 and the head cover 33 and a connecting position (second connecting position) of the blowby hose 56 and the intake device. However, the blowby hose 56 may be held by a plurality of brackets between the first connecting position and the second connecting position. In this case, the blowby hose 56 is held by the plurality of brackets, and therefore, stability of the blowby hose 56 is further increased.

Figure 8:
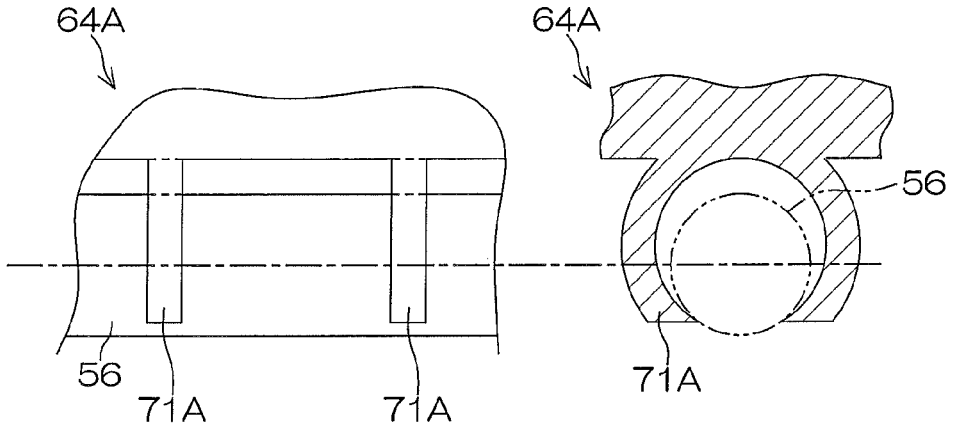
FIG. 8 is a schematic view showing a bracket according to a second preferred embodiment of the present invention.
Figure 9:
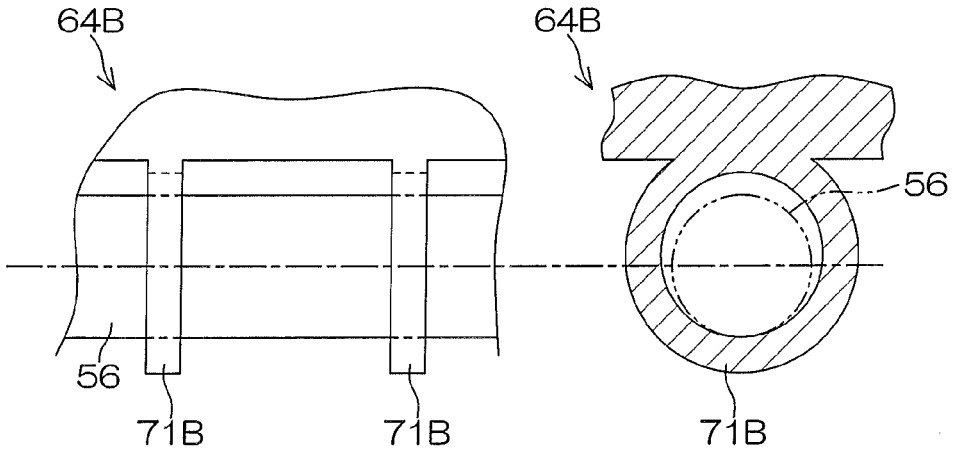
FIG. 9 is a schematic view showing a bracket according to a third preferred embodiment of the present invention.
Figure 10:
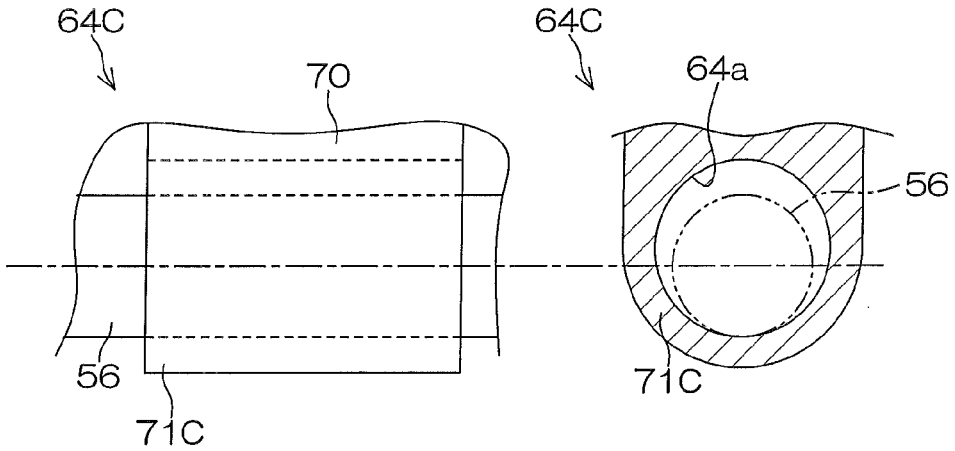
FIG. 10 is a schematic view showing a bracket according to a fourth preferred embodiment of the present invention.

Also, in the above-described preferred embodiments, a description has been given of a case where the bracket 64 preferably defines a portion of the second blowby gas passage 55. However, the bracket 64 may not define a portion of the second blowby gas passage 55. For example, as shown in FIG. 8 to FIG. 10, the blowby hose 56 may be disposed in a portion in the interior of the bracket. For each cross-section shown in FIG. 8 to FIG. 10, the bracket is cut along a plane orthogonal to the longitudinal direction of the blowby hose 56.

In the bracket 64A shown in FIG. 8, a portion of the blowby hose 56 is disposed in the interior of the bracket 64A, and the periphery of the blowby hose 56 is surrounded by a holding portion 71A of the bracket 64A. In this case, the holding portion 71A of the bracket 64A may have a C-shaped section, and the blowby hose 56 may penetrate the holding portion 71A (C-shaped portion) in the longitudinal direction of the blowby hose 56.

According to this arrangement of a preferred embodiment of the present invention, because the periphery of the blowby hose 56 is surrounded by the holding portion 71A of the bracket 64A, movement of the blowby hose 56 is prevented by the bracket 64A. Further, because the holding portion 71A has a C-shaped section, the force that restrains the blowby hose 56 by the bracket 64A is increased, and movement of the blowby hose 56 is reliably prevented. Wearing of or damage to the blowby hose 56 due to sliding of the blowby hose 56 and another member is thus reduced or prevented.

Also, in the bracket 64B shown in FIG. 9, a holding portion 71B (an annular portion) has an annular cross-section continuing throughout the entire circumference of the holding portion 71B, and the blowby hose 56 penetrates the holding portion 71B in the longitudinal direction of the blowby hose 56. The periphery of the blowby hose 56 is surrounded by the holding portion 71B. Thus, the force that restrains the blowby hose 56 by the bracket 64B is increased and detachment of the blowby hose 56 from the bracket 64B is reliably prevented. Wearing of and damage to the blowby hose 56 due to sliding of the blowby hose 56 and another member is thus reduced or prevented.

Also, in the bracket 64C shown in FIG. 10, an inner peripheral surface 64*a* of the bracket 64C defines a penetration hole extending in the longitudinal direction of the blowby hose 56, and the penetration hole penetrates the coupling portion 70 in the longitudinal direction of the blowby hose 56. The blowby hose 56 is inserted into the penetration hole, and a portion of the blowby hose 56 is disposed inside the penetration hole. Because the inner peripheral surface 64*a* of the bracket 64C continues throughout its entire circumference, movement of the blowby hose 56 in the radial direction of the holding portion 71C is reliably prevented. Further, because the inner peripheral surface 64*a* of the bracket 64C has a long cylindrical shape extending from one end surface of the coupling portion 70 to another end surface of the coupling portion 70, movement of the blowby hose 56 is reliably prevented over a longer distance in terms of the longitudinal direction of the blowby hose 56. Wearing of and damage to the blowby hose 56 due to sliding of the blowby hose 56 and another member is thus reduced or prevented.

Also, two or more of all preferred embodiments described above may be combined.

The present application corresponds to Japanese Patent Application No. 2013-169812 filed on Aug. 19, 2013 in the Japan Patent Office, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion apparatus comprising:

an engine main body including a crankshaft that is rotatable about a rotation axis extending in an up-down direction;

auxiliary machinery mounted on the engine main body;

a bracket that couples the auxiliary machinery to the engine main body, the bracket including a first mounting portion mounted on the engine main body, a second mounting portion mounted on the auxiliary machinery, a coupling portion coupling the first mounting portion and the second mounting portion to each other, and a holding portion provided in the coupling portion to hold wiring or piping; and an engine cowling that houses the engine main body, the auxiliary machinery, and the bracket; wherein the auxiliary machinery is an electrical device; and the bracket is housed entirely within the engine cowling.

2. The vessel propulsion apparatus according to claim 1, wherein the holding portion is disposed farther inward than the auxiliary machinery with respect to an inner surface of the engine cowling.

3. The vessel propulsion apparatus according to claim 1, wherein the holding portion includes a first piping mounting portion in which first piping is mounted and a second piping mounting portion in which second piping is mounted; and the bracket further includes a cylindrical inner peripheral surface that defines a penetration hole as a relay passage extending from an interior of the first piping to an interior of the second piping.

4. The vessel propulsion apparatus according to claim 1, wherein at least a portion of the holding portion surrounds a periphery of the wiring or piping.

5. The vessel propulsion apparatus according to claim 4, wherein at least a portion of the holding portion has a C-shaped cross-section disposed on the periphery of the wiring or piping.

6. The vessel propulsion apparatus according to claim 4, wherein at least a portion of the holding portion has an annular cross-section continuing throughout an entire circumference of the holding portion and disposed on the periphery of the wiring or piping.

7. The vessel propulsion apparatus according to claim 6, wherein the holding portion includes a cylindrical inner peripheral surface that defines a penetration hole penetrating the coupling portion in a longitudinal direction of the wiring or piping.

8. The vessel propulsion apparatus according to claim 1, wherein the holding portion is disposed over the engine main body and in a gap in a horizontal direction between the engine main body and the auxiliary machinery.

9. A vessel propulsion apparatus comprising:

an engine main body including a crankshaft that is rotatable about a rotation axis extending in an up-down direction;

auxiliary machinery mounted on the engine main body;

a bracket that couples the auxiliary machinery to the engine main body, the bracket including a first mounting portion mounted on the engine main body, a second mounting portion mounted on the auxiliary machinery, a coupling portion coupling the first mounting portion and the second mounting portion to each other, and a holding portion provided in the coupling portion and configured to hold wiring or piping; and an engine cowling that houses the engine main body, the auxiliary machinery, and the bracket; wherein the holding portion is disposed over the engine main body and in a gap in a horizontal direction between the engine main body and the auxiliary machinery;

the auxiliary machinery includes a starter motor mounted on the engine main body via the bracket and a ring gear that rotates together with the crankshaft by being driven to rotate by the starter motor; and the holding portion is disposed in a gap in the horizontal direction between the engine main body and the starter motor, and in a gap in an up-down direction between the engine main body and the ring gear.

10. The vessel propulsion apparatus according to claim 1, wherein the bracket directly couples the auxiliary machinery to the engine main body.

* * * * *